US007537535B2

(12) United States Patent
Dettwiler

(10) Patent No.: US 7,537,535 B2
(45) Date of Patent: May 26, 2009

(54) DEVICE FOR CONVERSION OF MOVEMENT

(75) Inventor: Hermann Dettwiler, Langenbruck (CH)

(73) Assignee: PLIM Corporation AG, Bern-Liebefeld (CH)

( * ) Notice: Subject to any disclaimer, the term of this patent is extended or adjusted under 35 U.S.C. 154(b) by 0 days.

(21) Appl. No.: 10/511,615

(22) PCT Filed: Mar. 24, 2003

(86) PCT No.: PCT/CH03/00186

§ 371 (c)(1),
(2), (4) Date: Jul. 21, 2005

(87) PCT Pub. No.: WO03/086855

PCT Pub. Date: Oct. 23, 2003

(65) Prior Publication Data

US 2005/0272552 A1 Dec. 8, 2005

(30) Foreign Application Priority Data

Apr. 17, 2002 (CH) ..... 0644/02

(51) Int. Cl.
*F16H 1/28* (2006.01)

(52) U.S. Cl. ..... 475/11; 475/6; 475/15; 475/16; 475/18; 475/332; 475/336

(58) Field of Classification Search ..... 475/11, 475/15, 18, 332, 336
See application file for complete search history.

(56) References Cited

U.S. PATENT DOCUMENTS

| | | | | |
|---|---|---|---|---|
| 2,539,436 | A | 1/1951 | Kost | |
| 2,831,663 | A * | 4/1958 | Nauta | 366/287 |
| 4,131,034 | A * | 12/1978 | Rolf | 475/11 |
| 5,090,869 | A * | 2/1992 | Wright | 416/147 |
| 6,302,486 | B1 * | 10/2001 | Lamart et al. | 297/411.37 |

FOREIGN PATENT DOCUMENTS

| | | |
|---|---|---|
| DE | 139759 | 4/1900 |
| DE | 4216531 | 11/1993 |
| FR | 639928 | 7/1928 |
| WO | WO 01/01017 | 1/2001 |

* cited by examiner

*Primary Examiner*—David D. Le
(74) *Attorney, Agent, or Firm*—Husch Blackwell Sanders Welsh & Katz

(57) ABSTRACT

A device for conversion of a rotational movement into a movement of each of two working levers defining a truncated cone and a self-rotating movement of each of the two working levers and vice versa comprises a lever bearing element which is rotatable around a rotation axis. The two working levers are each self-rotatably positioned around a self-rotation axis in the lever bearing element. A planetary wheel is arranged in a non-rotatable manner on each working lever. The planetary wheels are each coupled to a sun wheel, which is able to be blocked from turning, via a transmission wheel, the sun wheel being arranged around the rotation axis. This device for conversion of movement is utilisable for a great variety of uses and has a simple mechanical construction.

16 Claims, 9 Drawing Sheets

55
131
12
9
50
16
7
10
51
14
11
52
13
56
57
6
5
22
21
1
2
B
A
C
15
23
4
3
41
31

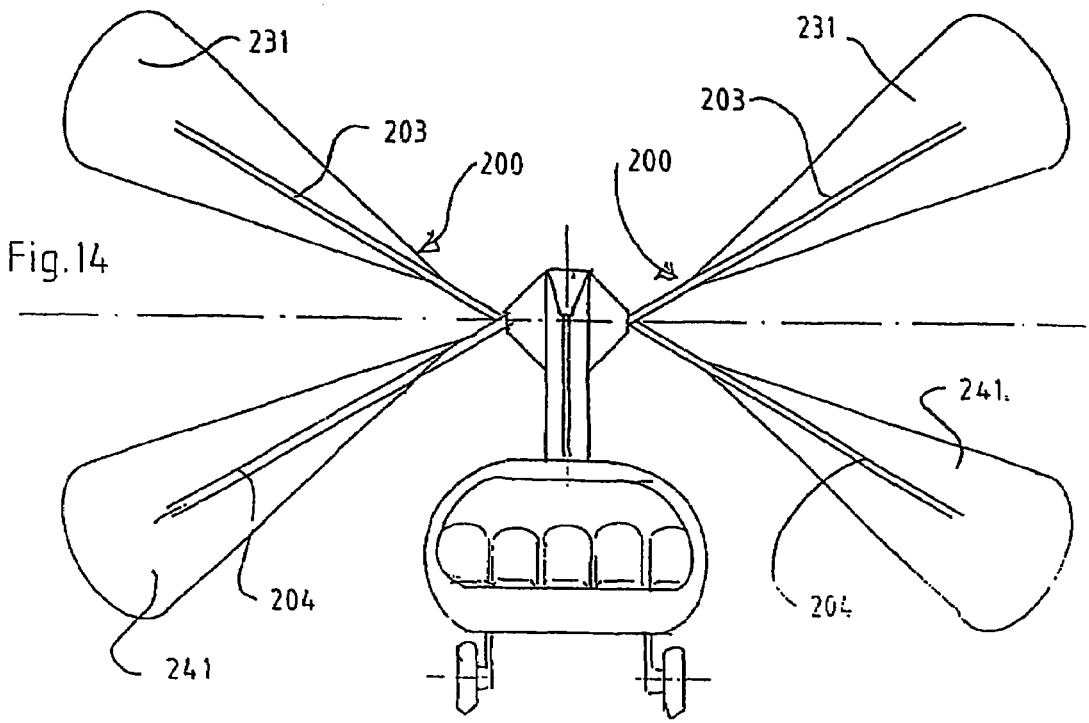
Fig.14
Fig.15
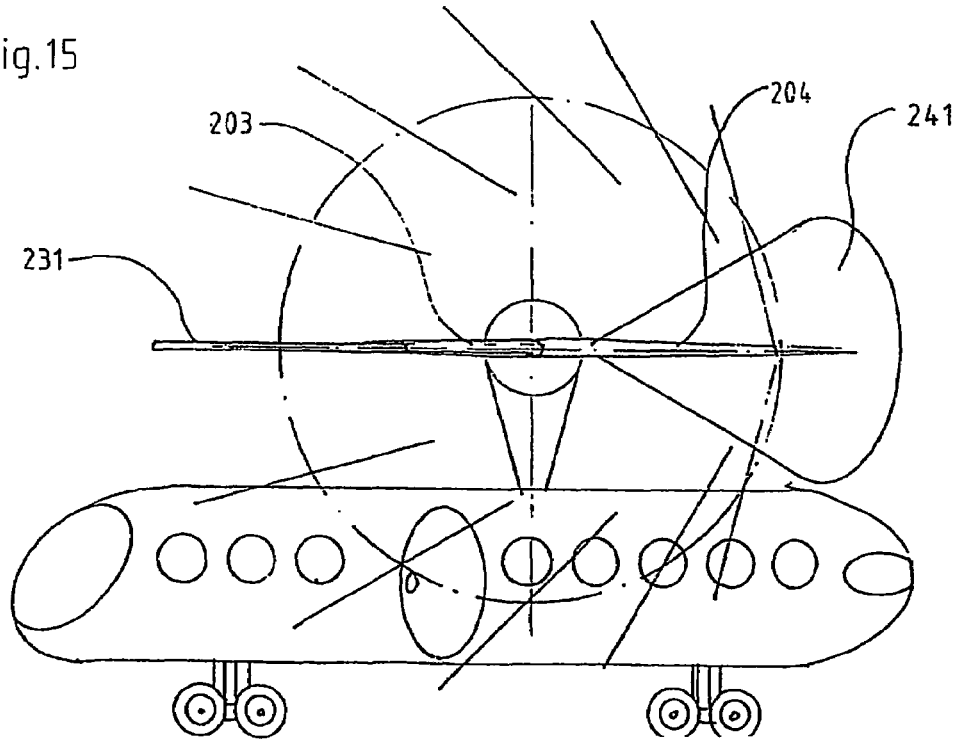

DEVICE FOR CONVERSION OF MOVEMENT

FIELD OF THE INVENTION

The present invention relates to a device for conversion of a rotational movement into a movement of a working lever defining a truncated cone and a self-rotating movement of the working lever, or vice versa, a movement of a working lever defining a truncated cone and a self-rotating movement of the working lever into a rotational movement.

BACKGROUND

In the case of turbo-machines, such as, for example, ship driving apparatuses, the propeller is currently the preferred current generating element. In principle, a propeller is a device which is mounted on a turning axle and which projects radially out of the axle circumference. Suitable propeller designs produce different effects corresponding to the respective requirements. In principle, propeller blades are used which project out obliquely from the rotational plane. When turning, the medium in which the propeller moves glides away from the blade edge of the propeller blades over its surface, because the medium striking after pushes the former medium away. This order of events is interrupted when, for example, in water, air reaches the propeller. The entire pressure formation that has been built-up collapses due to the thinner air and has to be built up again anew. Further disadvantages of the propeller are, for example, a turbulent current production, as well as a restricted range of the optimal effect. Also mention may be made of noise production, wear and tear, eddy formation and the causing of erosion in the surroundings. Additionally disadvantageous is that the periphery of the propeller moves at the brink of its physical capabilities, while at the same time the centre is practically inactive.

Therefore, on various occasions other devices for conversion of movement were developed, which are partly advantageous when utilized in turbo-machines.

For example, WO 01/01017 discloses a device for conversion of a rotational movement into a movement of a working lever defining a cone and a self-rotating movement of the working lever, or vice versa a movement of a working lever defining a cone and a self-rotating movement of the working lever into a rotational movement, in which the working lever is positioned in a non-rotatable manner in a lever bearing element. A rotatable rotational element is coupled with the working lever or the lever bearing element. The conversion of movement is made possible through the fact that the lever bearing element is swivelable around a swivel axis and is rotatable around a bearing rotation axis which is vertically standing on the swivel axis, and the bearing rotation axis and the swivel axis have a common point of intersection.

A disadvantage of this device for conversion of movement is its relatively complicated mechanical construction, in particular in relation to the bearing of the lever bearing element. In addition, it can not have several working levers due to the central arrangement of the working lever in the lever bearing element and the lever bearing element itself.

A mixer is known from U.S. Pat. No. 2,539,436, in which a rotational movement is converted into a movement of a mixer rod defining a cone and a self-rotating movement of the mixer rod. The mixer rod is self-rotatably positioned in a rotational element as well as swivelably self-rotatably positioned in a further bearing part. When the mixer rod rotates in a cone shape, a self-rotation in the opposite direction is performed. This is effected through a toothed wheel arranged on the mixer rod, the toothed wheel rolling inside of a toothed rim. The self-rotation in the opposite direction has a greater rotation speed than the cone-shaped rotation, which admittedly leads to a good mixing effect, but however is disadvantageous for other uses, for example as a driving apparatus for a watercraft or an aircraft.

DE-A-42 16 531 discloses a rotor arrangement with several rotor blades, whose turning axes lie vertical to the direction of current of a medium. The rotor blades are rotatably arranged on a common supporting means around an axis vertical to the plane of the supporting means. The supporting means is pivoted around a central axis. In the case of the rotation around the supporting means axis, a pivoting of the rotor blades around their rotor blade axes is achieved by means of transmission means. By the use of the parallel arrangement of the rotor blade axes, the rotor blades need relatively a lot of space.

From FR-A-639 928 a device for conversion of a rotational movement into a movement of a working lever having a paddle and defining a cone and a self-rotating movement of the working lever is known, which comprises a lever bearing element rotatable around a rotation axis, in which the working lever is self-rotatably positioned around a self-rotation axis. A sun wheel is arranged around the rotation axis, with which a planetary wheel, which is arranged in a non-rotatable manner on the working lever, is coupled via toothed wheels, such that with a rotation of the lever bearing element around the rotation axis, on the one hand, due to the positioning in the lever bearing element, the working lever carries out a rotation in the same direction of rotation, and, on the other hand, due to the planetary wheel coupled via the toothed wheels to the sun wheel, the working lever carries out a self-rotation around the self-rotation axis in the opposite direction of rotation. The disclosed device realises a driving apparatus with wavelike-changing driving power.

In view of the disadvantages of the previously known, above described devices for conversion of movement, the object of the invention is to provide a device for conversion of movement of the type as mentioned in the introduction, which is utilisable for a great variety of uses and which has a simple mechanical construction. Preferably it should be able to have several working levers.

SUMMARY OF THE INVENTION

The essence of the invention is the following: A device for conversion of a rotational movement into a movement of a working lever defining a truncated cone and a self-rotating movement of the working lever, or vice versa a movement of a working lever defining a truncated cone and a self-rotating movement of the working lever into a rotational movement, comprises a lever bearing element which is rotatable around a rotation axis, in which the working lever is self-rotatably positioned around a self-rotation axis. Arranged around the rotation axis is a sun wheel, which is able to be blocked from turning, with which a planetary wheel, arranged in a non-rotatable manner on the working lever, is coupled via a transmission means, such that with a rotation of the lever bearing element around the rotation axis, on the one hand, due to the positioning in the lever bearing element, the working lever carries out a rotation in the same direction of rotation and, on the other hand, due to the planetary wheel which is coupled to the sun wheel via the transmission means, the working lever carries out a self-rotation around the self-rotation axis in the opposite direction of rotation. According to the invention, the device has at least a further working lever, which is self-rotatably positioned in the lever bearing element around a self-rotation axis and on which a planetary wheel is arranged in a non-rotatable manner, the planetary wheel being coupled via a transmission means with the sun wheel or with a further sun wheel arranged around the rotation axis, such that with a rotation of the lever bearing element around the rotation axis, on the one hand, due to the positioning in the lever bearing element, the further working lever carries out a rotation in the same direction of rotation, and on the other hand, due to the planetary wheel coupled to the sun wheel via the transmission means, the further working lever carries out a self-rotation around the self-rotation axis in the opposite direction, wherein the at least two working levers are arranged obliquely and at a distance to the rotation axis and cross each other.

When the lever bearing element rotates, the blocking of turning of the sun wheel results in two overlapping rotational movements of the working lever. On the one hand, the working lever rotates with the lever bearing element, due to the positioning in the lever bearing element. On the other hand, the working lever executes a self-rotation, effected through the planetary wheel, wherein the planetary wheel is rotated in the direction of rotation opposite to the direction of rotation of the lever bearing element, due to the rotation of the lever bearing element around the rotation axis, through the transmission means and the sun wheel which is blocked from turning. The two overlapping, contra-rotating rotational movements of the working lever have the consequence that the resulting rotational movement of the working lever has a lower rotation speed than the lever bearing element.

Since a planetary wheel, a transmission means and a sun wheel are used for production of the self-rotation of the working lever, the lever bearing element bearing the working lever can be more simply constructed, in comparison to the device disclosed in WO 01/01017. In particular it does not have to be swivelably designed. In addition it is not necessary that the working lever operates through the centre of the lever bearing element and the point of a cone defined through the movement of the working lever, such that the device according to the invention can have several working levers, which are positioned in the same lever bearing element. This leads to a considerable increase in the variety of potential uses.

Despite this simpler construction and the possibility of the use of several working levers, conversion of movements can be carried out, which are similar to those of the device disclosed in WO 01/01017. The advantages over a propeller device are thus retained, for example, the production of a less turbulent current, a greater range of the optimal effect, a lower noise production, lower wear and tear, a lower erosive effect on the surroundings and extended active zones of effect of the working lever.

Advantageously, a rotation-transmission ratio exists between planetary wheel and sun wheel, such that with a rotation of the lever bearing element around 360°, the working lever self-rotates around less than 360°. This means that the self-rotation of the working lever occurs with a lower frequency than the rotation of the lever bearing element and the movement of the working lever defining a truncated cone or a cylinder. The transmission can be achieved either through suitable design of the planetary wheel and the sun wheel, or through the transmission means.

Advantageously, a rotation-transmission ratio of 2:1 exists between planetary wheel and sun wheel. Thus the working lever performs a self-rotation of 180° when the lever bearing element rotates 360°. With a suitable operating tool, for example a flat paddle, on the working lever, a directed current or drive can thus be produced in a desired direction or a current can be optimally taken over.

Preferably, the device according to the invention has means with which the sun wheel is rotationally adjustable and which, except when rotationally adjusting, block the sun wheel from turning, i.e. keep it in a non-rotatable manner. Through rotationally adjusting the sun wheel, the self-rotation position of the working lever can be adjusted via the planetary wheel, which is coupled to the sun wheel via the transmission means. This, for example, can be used for the steering of a watercraft or aircraft. The blocking of turning of the sun wheel preferably takes place with the same means.

In a preferred embodiment, these means comprise a chain wheel connected with the sun wheel, a further, rotationally adjustable chain wheel and a chain connecting the two chain wheels. The rotationally adjustment of the sun wheel can thus occur at a position away from the rotation axis.

In a preferred embodiment, the planetary wheel, the transmission means and the sun wheel are toothed wheels.

In another preferred embodiment, the planetary wheel and the sun wheel are chain wheels, while the transmission means is a roller chain connecting the chain wheels. This makes it possible to produce the device with simpler standard parts.

Alternatively, the transmission means is a belt, for example a V-belt or a flat belt, in particular made out of rubber or leather, or a toothless wheel, for example made out of rubber or a plastic.

In an advantageous embodiment, the planetary wheels of the at least two working levers are coupled with the same sun wheel.

In particular, with two working levers with suitable operating tools, a directed current or a drive in a desired direction can be even better produced than with only one working lever. Also in the case of use as mixer device, two or more working levers prove to be advantageous, since the operating tools of the different working levers can feed the material to be mixed back and forth to each other.

In another advantageous embodiment, the planetary wheels of the at least two working levers are coupled with separate sun wheels. This makes it possible to separately adjust the self-rotation position of each working lever, which can be used to alter the drive direction or the direction of the produced current. In the case of flying machines, these individual adjustment possibilities can also make the airframe suitable to glide. This is, for example, very important in the case of motor failure during the flight. With mix and/or stirring devices, other mix and/or stirring effects can be attained through the adjustment of the self-rotation position of a working lever.

In these embodiments with at least two working levers and a sun wheel or several sun wheels, the planetary wheels of the working levers or the sun wheels could each have the same or different number of teeth, or, between the planetary wheels and the sun wheel or the sun wheels, different rotation-transmission ratios could exist, according to what should be produced.

Preferably, the lever bearing element is pivotably arranged in a casing and is connected with a shaft which is arranged on the rotation axis and which projects out of the casing. The casing forms the fixed, supporting part of the device and in addition extensively protects the rotating parts from dirtying.

In an advantageous embodiment, the lever bearing element is connected with a motor for production of the rotational movement, and an operating tool, in particular a paddle, a vane or a wing blade, is arranged on each of the working levers. Such a device can, for example, be used as driving apparatus and/or steering of a locomotion means in water or in air, for production of a water or gas current or for mixing of flowable materials.

In another advantageous embodiment, a torque consumer is connected with the lever bearing element, in particular a current generator. Such a device can, for example, be used for current production through conversion of a movement defining a truncated cone of a working lever with an operating tool, produced through flowing water or wind, and conversion of a self-rotating movement of the working lever produced through flowing water or wind, into a rotational movement of the lever bearing element, and taking over of the torque of the lever bearing element.

BRIEF DESCRIPTION OF DRAWINGS

The device for conversion of movement according to the invention is described in more detail herein below by way of exemplary embodiments and with reference to the attached drawings, in which:

FIG. 14 shows schematically in a front view the use of two devices for conversion of movement according to FIG. 9 as driving apparatuses of a flying machine;

FIG. 15 shows the flying machine with the two driving apparatuses of FIG. 14 in a side view;

DETAILED DESCRIPTION

Figure 1:
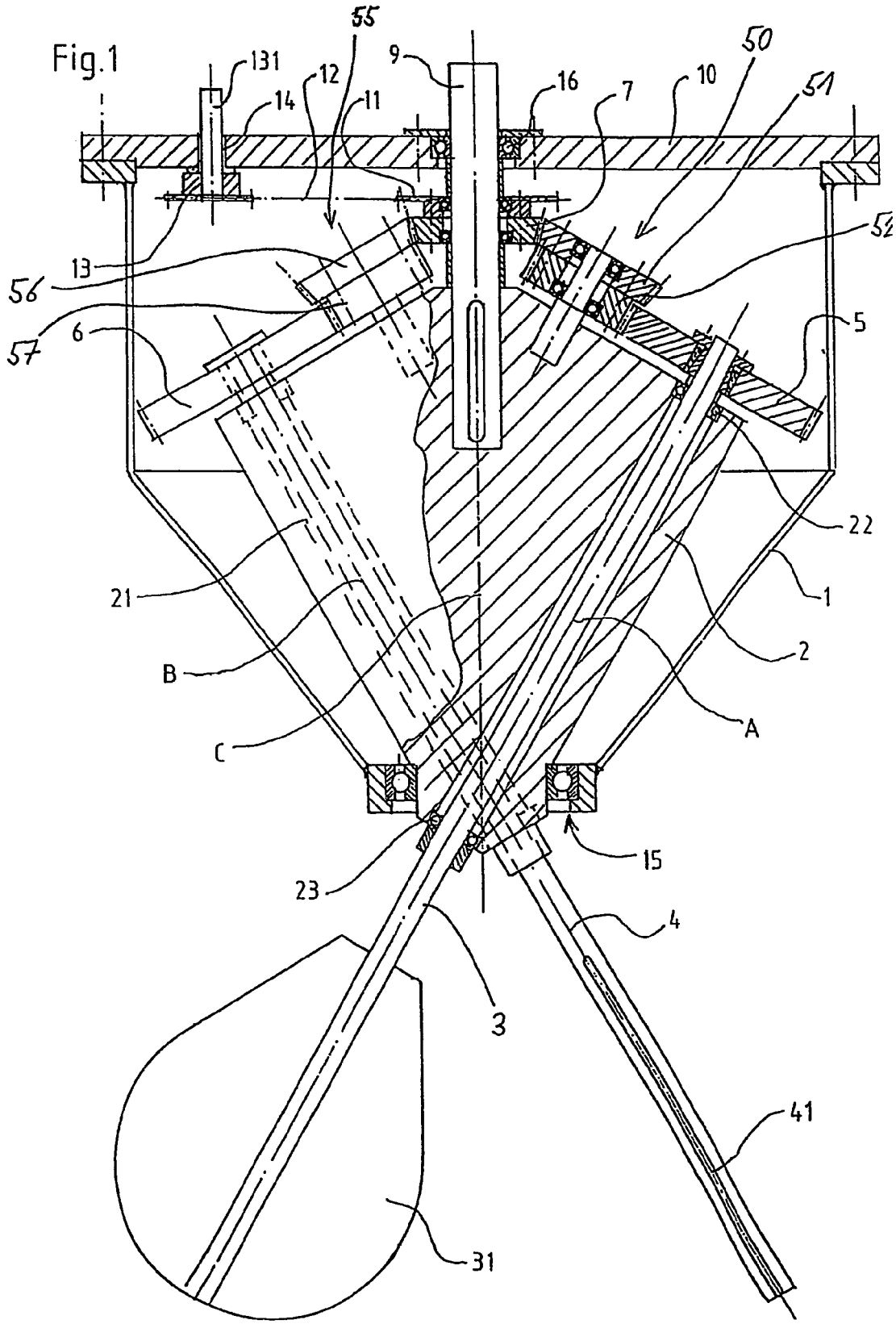
FIG. 1 shows a partial section view of a first exemplary embodiment of the device according to the invention for conversion of movement, with two crossed working levers with a common sun wheel and toothed wheels as transmission means.

In FIG. 1 a first exemplary embodiment of the device according to the invention for conversion of movement is shown, which is, for example, suitable for a ship driving apparatus. The device has as a supporting element a casing 1, which keeps the remaining mechanical parts in a defined position. In order to make the installation and removal of the parts arranged in casing 1 easier, the casing 1 is provided with a detachable casing cover 10. A lever bearing element 2 in the form of a support yoke is rotatably arranged in the inside of the casing 1. The lever bearing element 2 is pivoted in the lower part of the casing 1 in a roller bearing 15. From above a drive shaft 9 projects into the lever bearing element 2, that is connected in a non-rotatable manner with it. The drive shaft 9 is guided via a roller bearing 16 through the casing cover 10, such that it can be driven from the outside of the casing 1 and at the same time stabilises the lever bearing element 2.

The lever bearing element 2 comprises two boreholes 21 running from the upper outside to the lower inside, in which upper and lower pivot bearers 22 and 23 are arranged. A working lever 3 or 4 is guided through each borehole 21, the working lever 3 or 4 being pivoted through the pivot bearers 22, 23. The working levers 3, 4 take a crossed course, distanced however from each other, and each has an operating tool in the form of a paddle 31 or 41. When the drive shaft 9 rotates, the lever bearing element 2 and the working levers 3, 4 are rotated with it, such that the parts of the working levers 3, 4 projecting down out of the casing 1 each carry out a movement defining a truncated cone.

In order to also produce a self-rotation of the working levers 3, 4 around the self-rotation axes A, B when the lever bearing element 2 rotates, the working levers 3, 4 are each provided on their upper ends with a planetary wheel 5, 6. The planetary wheels 5, 6 are shaped as toothed wheels and are coupled via transmission wheels 50, 55 with a sun wheel 7 in the form of a toothed wheel. The transmission wheels 50, 55 are each shaped as double toothed wheels, i.e. they each comprise two toothed wheels 51, 52 or 56, 57 connected with each other, of which one meshes with the planetary wheel 5, 6 and the other meshes with the sun wheel 7. The sun wheel 7 is arranged around the drive shaft 9 and its rotation axis C and is rotatable relative to the drive shaft 9. It is firmly connected to a chain wheel 11, which is connected via a chain 12 with a chain wheel 13 which is rotationally adjustable. The chain wheel 13 is fixed on a shaft 131, which is pivoted in a roller bearing 14. The sun wheel 7 is rotationally adjustable via the shaft 131, the chain wheel 13, the chain 12 and the chain wheel 11. When the sun wheel 7 is rotationally adjusted, the planetary wheels 5 and 6 which are coupled to that via the transmission wheels 50, 55 and the working levers 3 and 4 connected with the planetary wheels 5, 6 are also rotationally adjusted, such that, in this way, the self-rotation position of the working levers 3, 4 can be adjusted. However, in general, during the rotation of the lever bearing element 2, the sun wheel 7 is blocked from turning, by the chain wheel 13, the chain 12 and the chain wheel 11 being kept still. Through the rotation of the working levers 3, 4 around the rotation axis C, the planetary wheels 5, 6 are rolled via the transmission wheels 50, 55, which are changing the direction of rotation, on the sun wheel 7, whereby the working levers 3, 4 are provided with a self-rotation in the contrary direction of rotation.

According to the ratio of the number of teeth of the planetary wheels 5, 6, of the sun wheel 7 and of the transmission wheels 50, 55, when the lever bearing element 2 rotates 360°, a self-rotation of the working levers 3, 4 occurs in the opposite direction around a larger or smaller angle. In the case of the present exemplary embodiment, the planetary wheels 5, 6 have exactly double so many teeth as the sun wheel 7. Thus, with a rotation of the lever bearing element 2 of 360°, the working levers 3, 4 execute a self-rotation of 180° in the opposite direction. Due to the movement of the working levers 3, 4 defining a truncated cone and the self-rotating movement of the working levers 3, 4, a directed current or a drive in a desired direction is produced through the paddles 31, 41.

The following applies to the rest of this description. If, in order to clarify the drawings, a figure contains designations which are not explained in the directly associated text of the description, or vice versa, then you are referred to the point at which they have been mentioned in previous descriptions of the figures.

Figure 2:
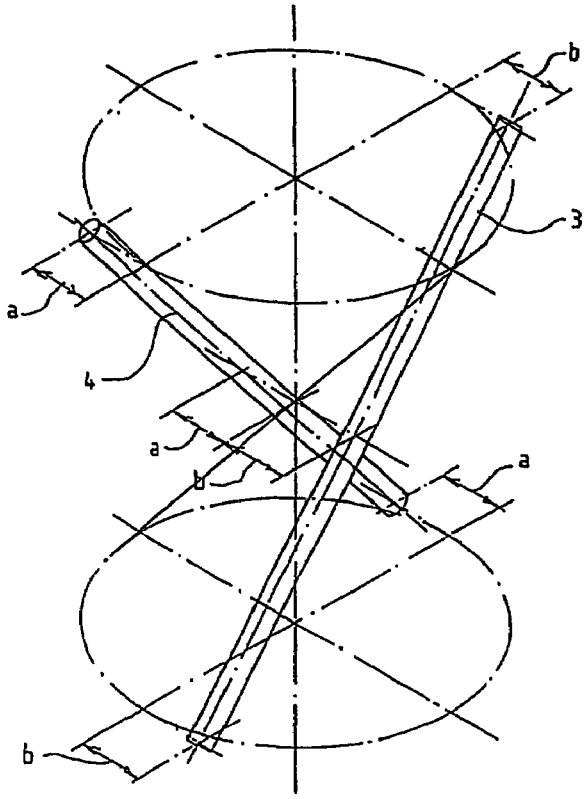
FIG. 2 shows schematically the arrangement of the working levers of the device of FIG. 1 with regard to a theoretical double cone.

FIG. 2 shows the arrangement of the working levers 3, 4 with regard to a theoretical double cone, which is defined through the movement of an endless thin working lever, which is guided through the axial centre of the lever bearing element 2, so that it cuts the rotation axis C. Since both working levers 3, 4 can not be guided through the same centre, they are each displaced a distance a or b to the middle of the double cone, wherein preferably the two distances are the same size. When the lever bearing element 2 rotates the working levers 3, 4 thereby do not define a cone, but only a truncated cone.

The variant with only one working lever cutting the rotation axis C is a special case of the invention, since in this case the movement of the working lever approximately defines a cone. A cone, however, always also contains truncated cones, so that the definition of the invention also applies here.

Figure 3:
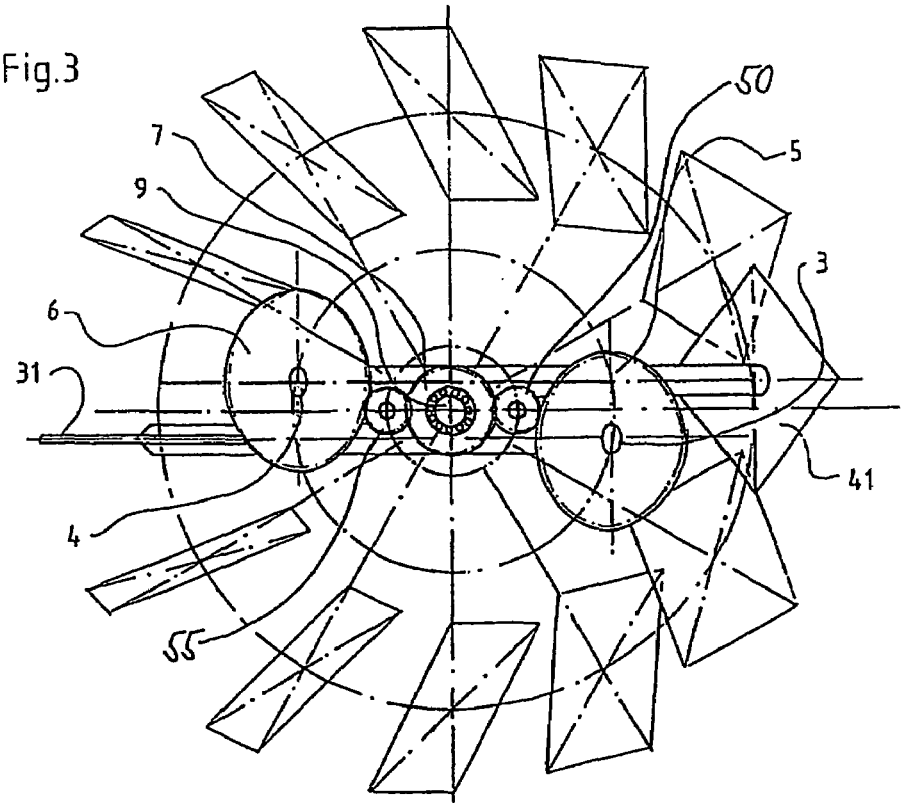
FIG. 3 shows schematically the movement of paddles of the two working levers during a rotational movement of the lever bearing element of 360°.

In FIG. 3 the movement of the paddles 31, 41 of the two working levers 3, 4 during a rotational movement of the drive shaft 9 and of the lever bearing element 2 of 360° can be gathered. The working levers 3, 4, the paddles 31, 41, the planetary wheels 5, 6, the transmission wheels 50, 55, the sun wheel 7 and the drive shaft 9 are schematically presented in one position. Further positions of the paddles 31, 41 are drawn with lines interrupted by dots. It is clear that the working levers 3, 4 with the paddles 31, 41 execute a self-rotation of 180° in the opposite direction, when the drive shaft 9 rotates 360°, during which they carry out a movement defining a truncated cone. This can be attributed to the fact that the planetary wheels 5, 6 have double so many teeth as the sun wheel 7.

Figure 4:
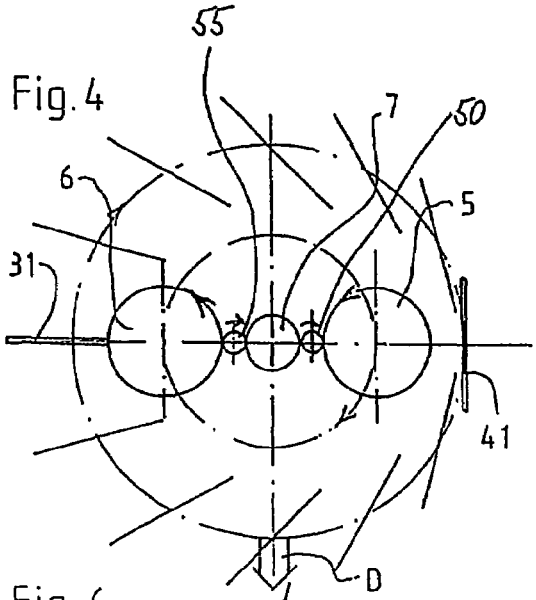
FIGS. 4 to 8 show schematically the alteration of the positions of the paddles and the drive direction in the case of an adjustment of the sun wheel.
Figure 5:
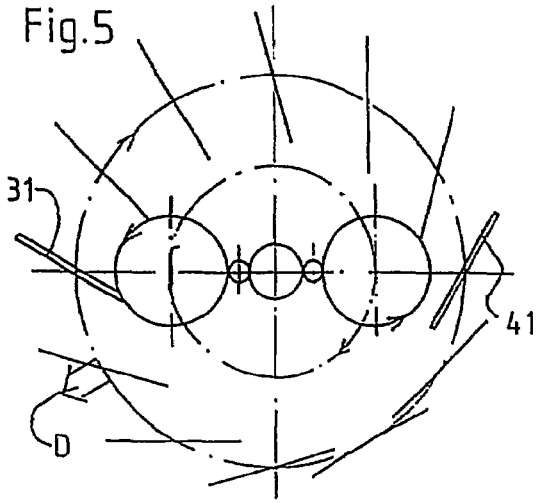
Figure 6:
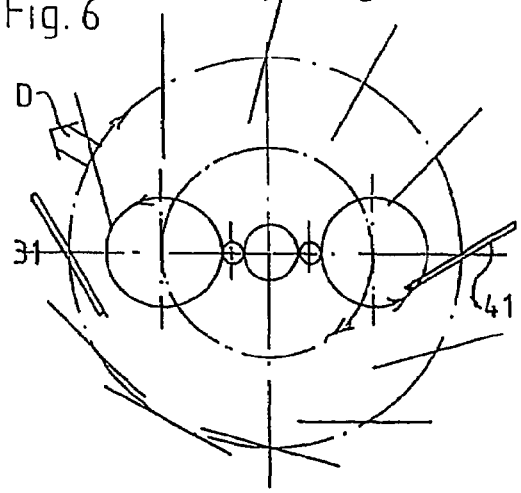
Figure 7:
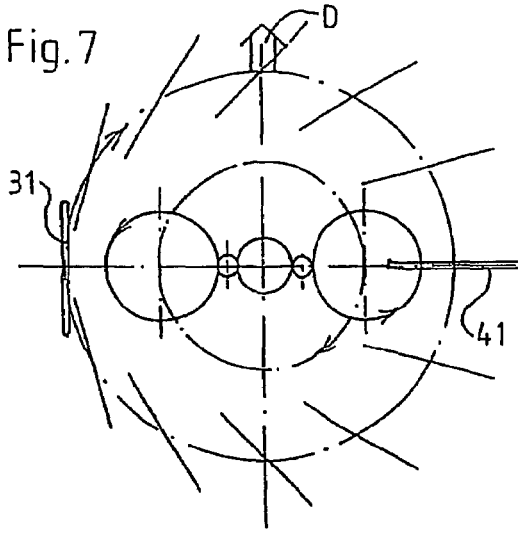
Figure 8:
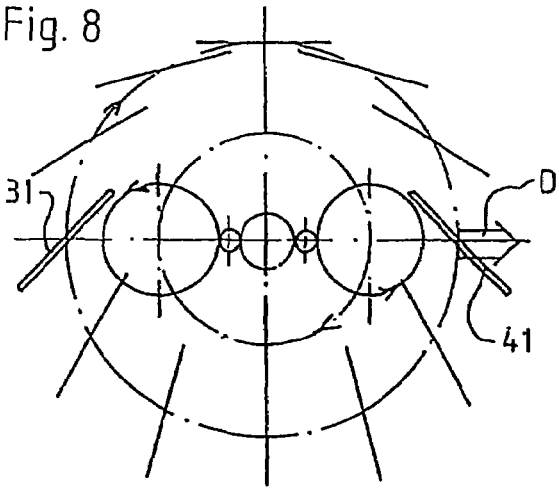

When the drive shaft 9 rotates in the clockwise direction, through the resulting paddle movements, a current towards 12 o'clock, or, with utilisation in a locomotion means, e.g. a ship, a drive of the locomotion means towards 6 o'clock is brought about, as shown in FIG. 4 through an arrow D. In FIGS. 4 to 9, in contrast to FIG. 3, the paddles 31, 41 are not drawn correctly displaced to the planetary wheels 5, 6 in the top view for the sake of simplicity, (the displacement results from the oblique, not through the rotation axis C-running arrangement of the working levers 3, 4).

The self-rotation positions of the working levers 3, 4 with the paddles 31, 41 in FIG. 4 can be adjusted through rotational adjustment of the sun wheel 7, whereby the drive direction D is changed. In FIGS. 4 to 8 different drive directions D and corresponding self-rotation positions of the working levers 3, 4 are shown by the orientation of the paddles 31, 41.

Figure 9:
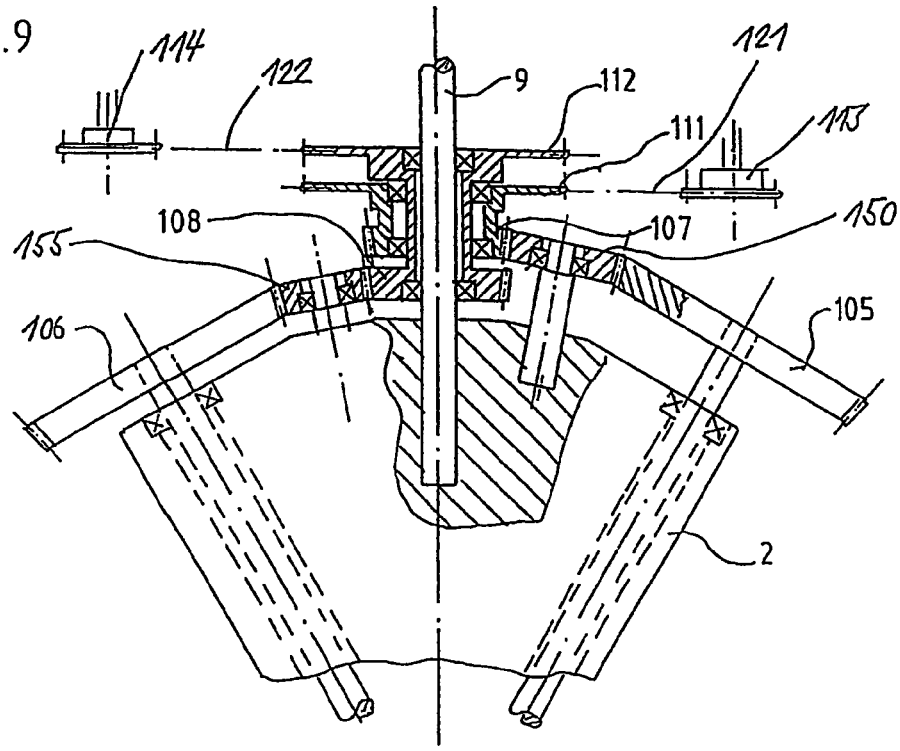
FIG. 9 shows a part of a partial section view of a second exemplary embodiment of the device according to the invention for conversion of movement, with two working levers with separate sun wheels.

The second exemplary embodiment, shown in FIG. 9, of the device according to the invention for conversion of movement, has two working levers with planetary wheels 105, 106, which mesh with two separate sun wheels 107, 108 via transmission wheels 150, 155. Both sun wheels 107, 108 are individually rotatably arranged around the shaft 9 and each connected with an own chain wheel 111, 112, via which, by means of chains 121, 122 and chain wheels 113, 114, they are rotationally adjustable and able to be blocked from turning. This makes it possible that the self-rotation position of each working lever 3, 4, and with it the position of each paddle 31, 41, is individually adjustable. Through this individual adjustability of the self-rotation positions and, if need be, the use of planetary wheels 5, 6 or sun wheels 107, 108 with different numbers of teeth, for example, additional current effects, mix effects or stirring effects can be produced. In the case of flying machines similar to helicopters these adjustment possibilities can make the air frame suitable for gliding flights.

Figure 10:
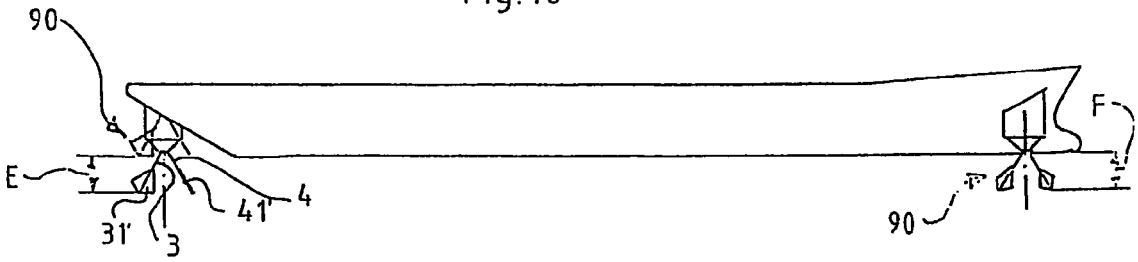
FIG. 10 shows schematically, in side view, the use of four devices for conversion of movement according to FIG. 1 as ship driving apparatuses.
Figure 11:
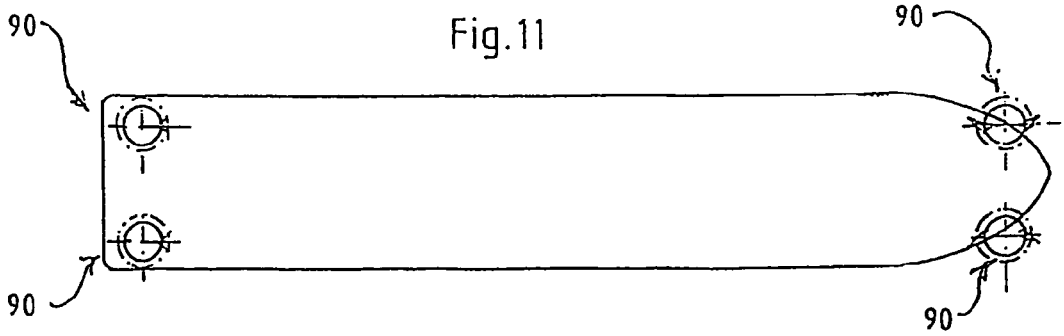
FIG. 11 shows the ship with the four driving apparatuses of FIG. 10 from a top view.
Figure 12:
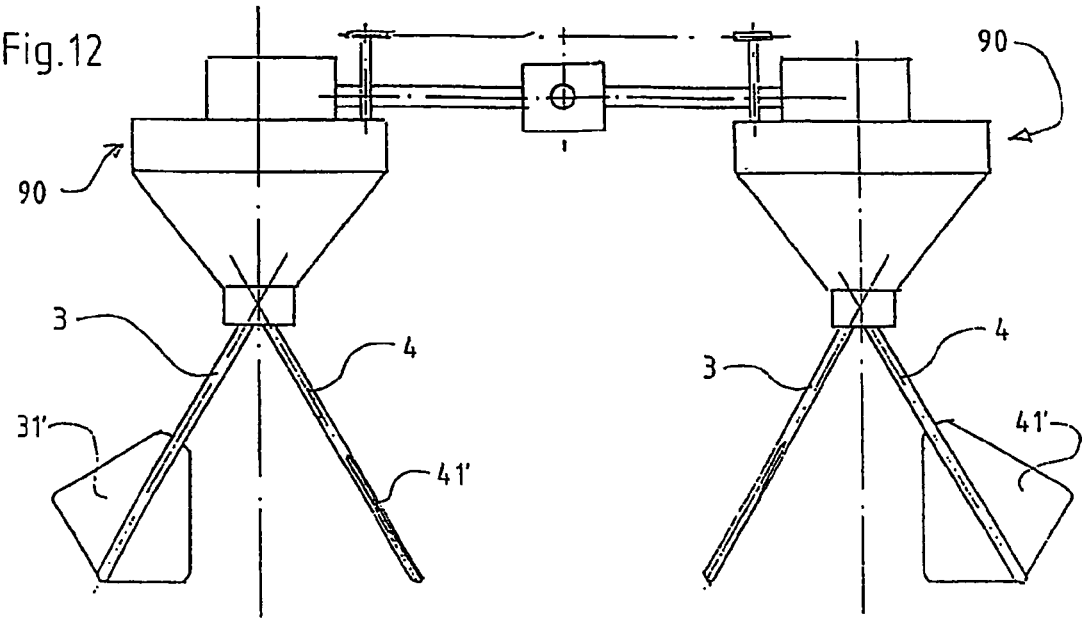
FIG. 12 shows a more detailed view of two connected driving apparatuses from FIG. 10.

FIGS. 10 and 11 show a ship, that has four devices 90 for conversion of movement according to FIG. 1 as driving apparatuses. The driving apparatuses 90 are connected in pairs with each other, as shown in FIG. 12. The heights of these connected unities are adjustable according to the arrows E and F in FIG. 10, such that the depth of immersion of the paddles 31', 41' can be changed. This makes it possible, for example, to pull up the paddles 31', 41' in a flat stretch of water, so that the bottom of the body of water is not touched. The driving apparatuses 90 according to the invention have the advantage that a thrusting moment is produced also with partial emergence of the paddles 31', 41', so that they are also very suitable for flat-going river crafts.

Since, in the presented exemplary embodiment, driving apparatuses 90 are also provided on the bow side, a precise steering is possible, such that a high manoeuvrability can be achieved. The ship can thus also be kept on course with strong side winds despite a reduced draft. By means of the direction of thrust, which is adjustable over 360°, of each single driving apparatus 90, all manoeuvres are safely performed. In the case of river valley journeys, in thrust reversal the rear driving apparatuses 90 can slow down the stern, while the bow side driving apparatuses 90 pull the ship on full-thrust. A further advantage is that such a ship does not need a ruder arrangement. In addition, significantly higher speeds can be driven with this drive system.

Figure 13:
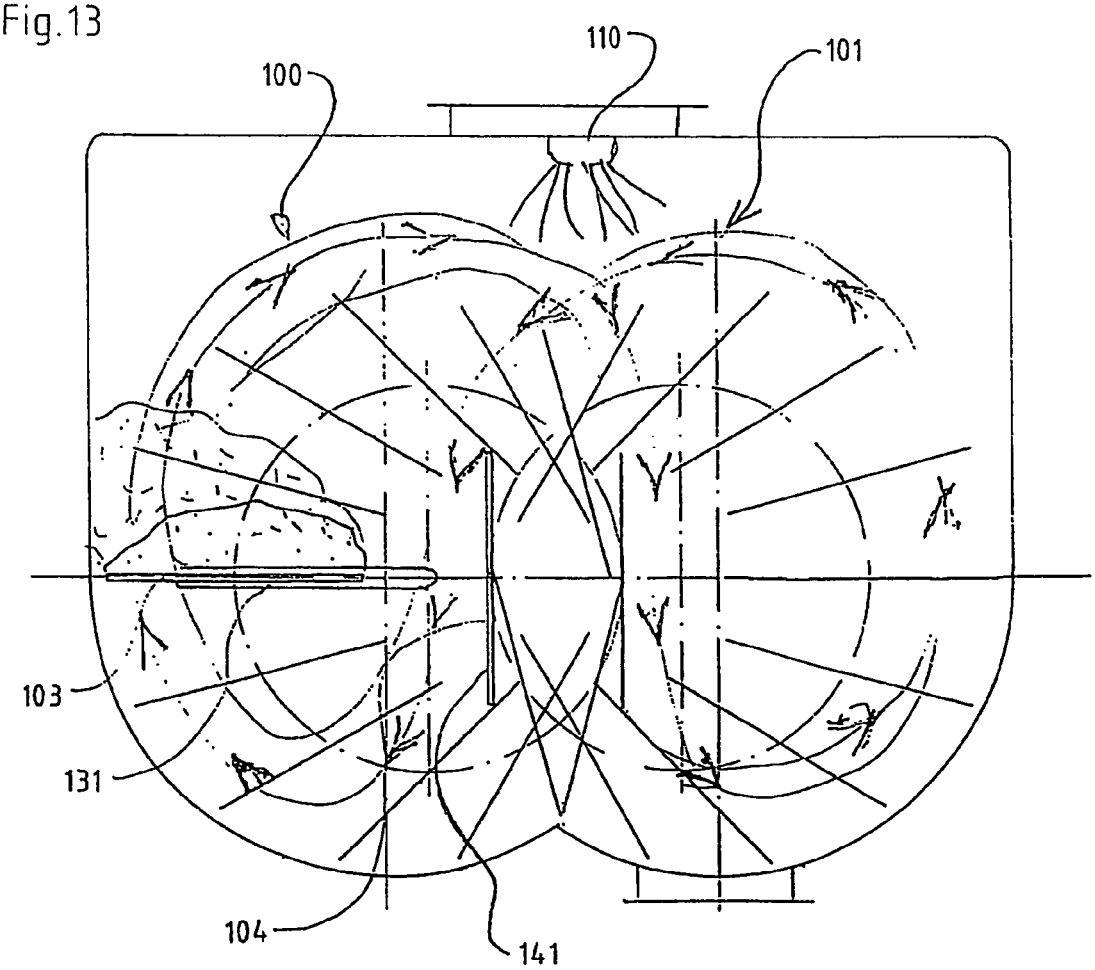
FIG. 13 shows schematically the use of two devices according to the invention for conversion of movement, each with one working lever, as mixer.

FIG. 13 shows the principle of a solid mixer, which produces a counter current by means of two driving apparatuses 100, 101 according to the invention, which lie next to each other, overlap into each other, each having a working lever 103, 104 and a vane 131, 141 as operating tool. Conventional two shaft mixers work with vanes which press the material to be mixed against each other, which requires a high energy input and exposes the material to be mixed to high pressure. This is not the case for this mixer according to the invention, in which a vane 131, 141 lifts up the material to be mixed outwardly around and feeds it over the middle to the vane 131, 141 which is going in the opposite direction. A fluidisation of the material to be mixed occurs with suitable turning speed, which permits spraying in of additions in the fluidisation zone via a nozzle head 110.

FIGS. 14 and 15 show a new type of flying machine, which is itself realised through the device for conversion of movement according to the invention. With this are two driving apparatuses 200 according to FIG. 9, each with two working levers 203, 204 and wing blades 231, 241, mounted against each other, such that two wing pairs can axial-symmetrically execute the wing beat movements. The wing beats correspond in principle to the wing movements of flying insects, which can be observed by means of high speed cameras.

Each wing blade is separately controlled for the steering of the flying machine, such that a great variety flying manoeuvres are possible, e.g. forwards, rearwards, upwards, downwards and curved flying, as well as gliding with a switched off motor. The flying machine can easily be designed so that the wing tips first achieve the critical sound barrier with a rate of travel of over 750 km/hr. From wind tunnel trials it is in addition known that the noise build up is minimal. The device according to the invention for conversion of movement thus makes possible the realisation of a low-noise flying machine, whose driving system has a high thrust and accelerates the air without large inactive zones.

Figure 16:
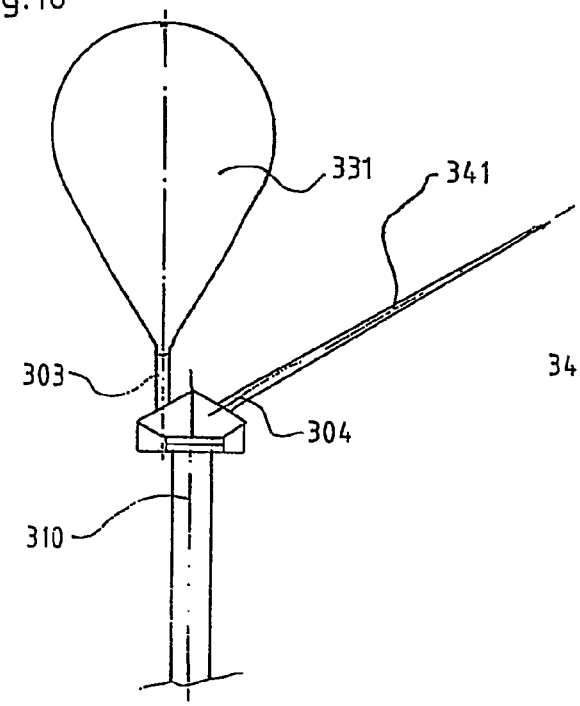
FIG. 16 shows schematically in a front view the use of two devices according to the invention for conversion of movement, each with one working lever, as wind power installation.
Figure 17:
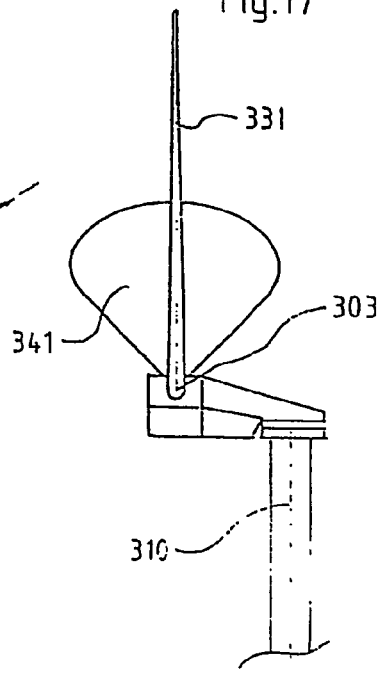
FIG. 17 shows the wind power installation of FIG. 16 in a side view.

In FIGS. 16 and 17 a wind power installation is shown, which comprises two devices for conversion of movement according to the invention, each with a working lever 303, 304, each of which has a wind surface 331, 341. The two devices are axial-symmetrically arranged and mechanically connected, such that through the wind striking on the wind surfaces 331, 341, courses of motion of the working levers 303, 304 in the opposite direction are produced. The movements of the working levers 303, 304 are converted into rotational movements, which are used for production of current by means of a current generator (which is not shown). By means of eccentric assembly of the devices on a pylon 310 with pivot bearings, the devices automatically always revolve in the wind direction, such that the sun wheel does not need to be adjustably mounted for this use. Moreover, besides the shown exemplary embodiment which has one working lever 303, 304 per each device, also exemplary embodiments with several working levers per device are possible.

Figure 18:
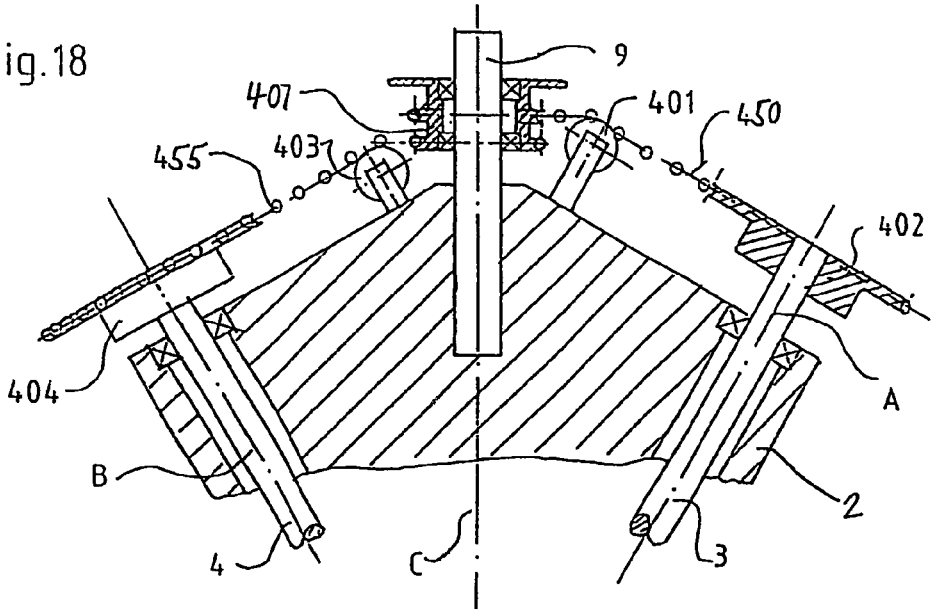
FIG. 18 shows a part of a partial section view of a third exemplary embodiment of the device according to the invention for conversion of movement, with two working levers with a common sun wheel and roller chains as transmission means.

The third exemplary embodiment, shown in FIG. 18, of the device for conversion of movement according to the invention largely corresponds to the first exemplary embodiment shown in FIG. 1. Instead of the transmission wheels 50, 55, which couple the planetary wheels 5, 6 with the sun wheel 7, endless roller chains 450, 455, directed via diverting wheels 401, 403, serve however as transmission means between the planetary wheels 402, 404 and the sun wheel 407. The planetary wheels 402, 404 and the sun wheel 407 are shaped as chain wheels. If the planetary wheels 402, 404 are equipped with double the number of engaging pieces, in comparison to the sun wheel 407, the same effect as in the case of the first exemplary embodiment is again achieved.

Figure 19:
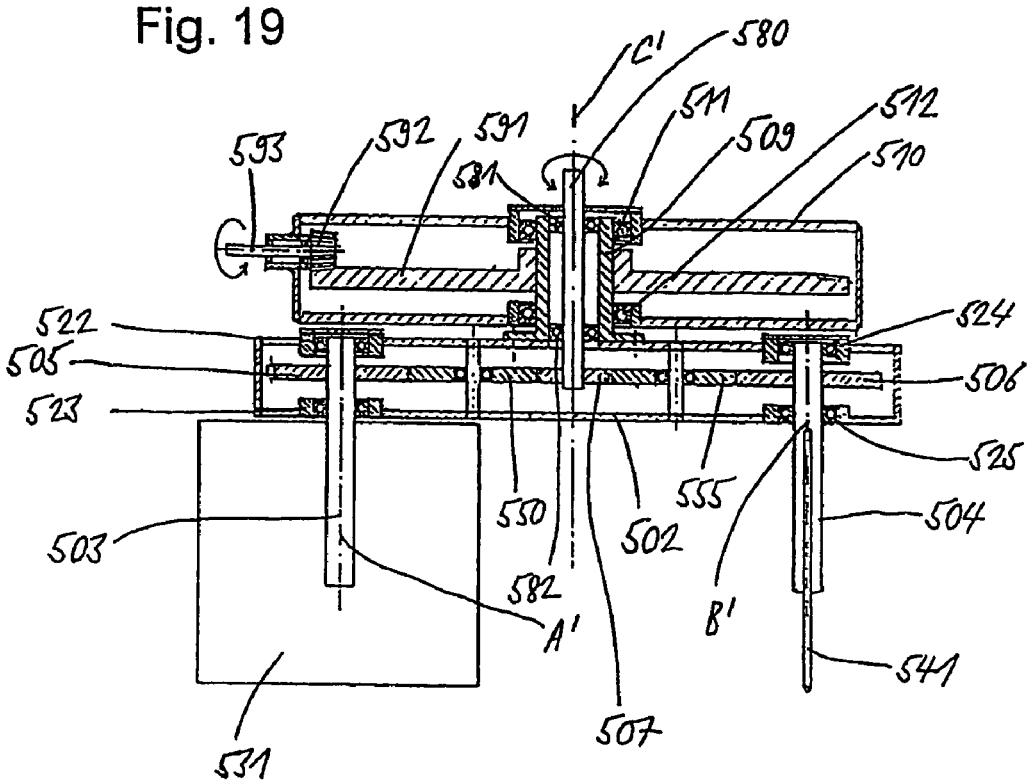
FIG. 19 shows a partial section view of a fourth exemplary embodiment of the device according to the invention for conversion of movement, with two working levers with self-rotation axes which are parallel to each other.

The fourth exemplary embodiment, shown in FIG. 19, of the device for the conversion of movement according to the invention has two working levers 503, 504 with paddles 531, 541 and self-rotation axes A', B'. The two self-rotation axes A', B' are parallel to each other. The working levers 503, 504 are pivoted through pivot bearers 522, 523, 524, 525 in a lever bearing element 502. The lever bearing element 502 is connected in a non-rotatable manner with a hollow drive shaft 509, which is rotatably positioned via roller bearers 511, 512 on a fixed part 510. Inside the fixed part 510 a toothed rim 591 is mounted externally around the drive shaft 509. Through rotation of a shaft 593, which is rotatably positioned on the fixed part 510 and is provided with a driving pinion 592, the drive shaft 509 can be rotated via the driving pinion 592 which meshes in the toothed rim 591. When the drive shaft 509 rotates, the lever bearing element 502 and the working levers 503, 504 are rotated together around a rotation axis C', such that the working levers 503, 504 each perform a movement defining a cylinder.

In order to also produce a self-rotation of the working levers 503, 504 around the self-rotation axes A', B' when the lever bearing element 502 rotates, the working levers 503, 504 are each provided on their upper ends with a planetary wheel 505, 506. The planetary wheels 505, 506 are shaped as toothed wheels and are coupled via transmission wheels 550, 555 with a sun wheel 507 in the form of a toothed wheel. The sun wheel 507 is fastened around the rotation axis C' on an adjustment shaft 580, which is pivoted via pivot bearers 581, 582 in the drive shaft 509. Via the adjustment shaft 580, the sun wheel 507 is rotatably adjustable, wherein when the sun wheel 507 is rotatably adjusted, also the planetary wheels 505, 506 coupled via the transmission wheels 550, 555 on it and the working levers 503, 504 connected with it, are rotationally adjusted. In this way the self-rotation position of the working levers 503, 504 can be adjusted. During the rotation of the lever bearing element 502, the sun wheel 507 is, in general, however, blocked from turning, such that through the rotation of the working levers 503, 504 around the rotation axis C', the planetary wheels 505, 506, via the transmission wheels 550, 555, which change the direction of rotation, are rolled on the sun wheel 507, whereby the working levers 503, 504 are provided with a self-rotation in the contrary direction of rotation.

Since the two working levers 503, 504 are not crossed and are arranged so that their self-rotation axes A', B' are parallel to each other, the device can be built very compactly with regards to height. Therefore, it is especially suitable, for example, for driving apparatuses of ships, which are employed on rivers with low water levels.

Figure 20:
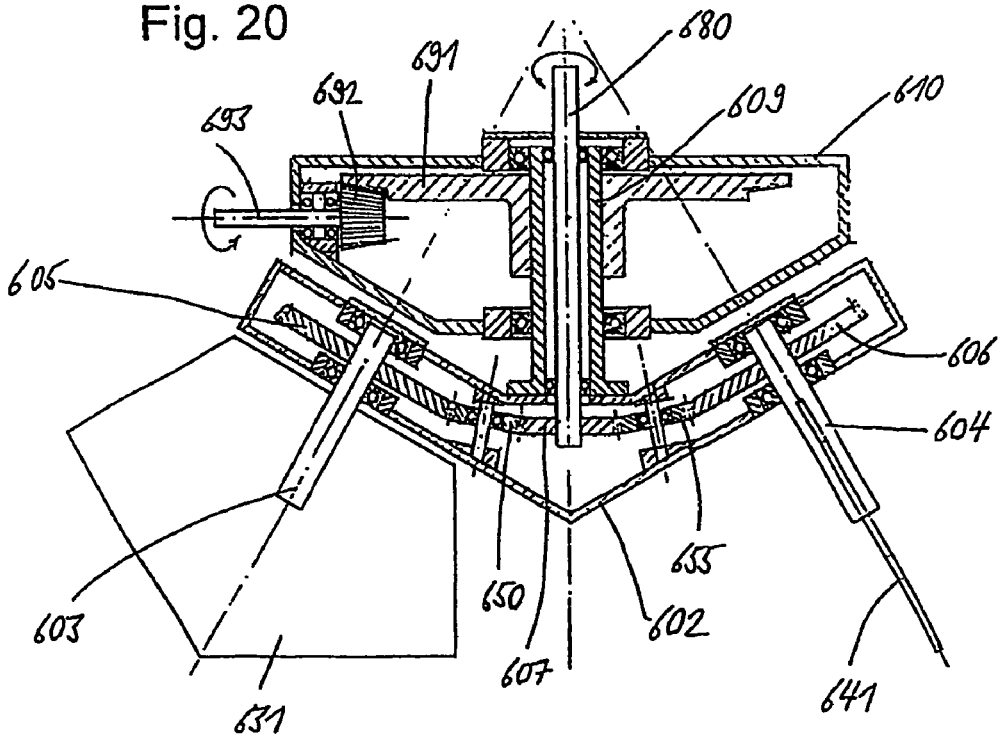
FIG. 20 shows a partial section view of a fifth exemplary embodiment of the device according to the invention for conversion of movement, with two obliquely arranged, not crossing working levers.
Figure 21:
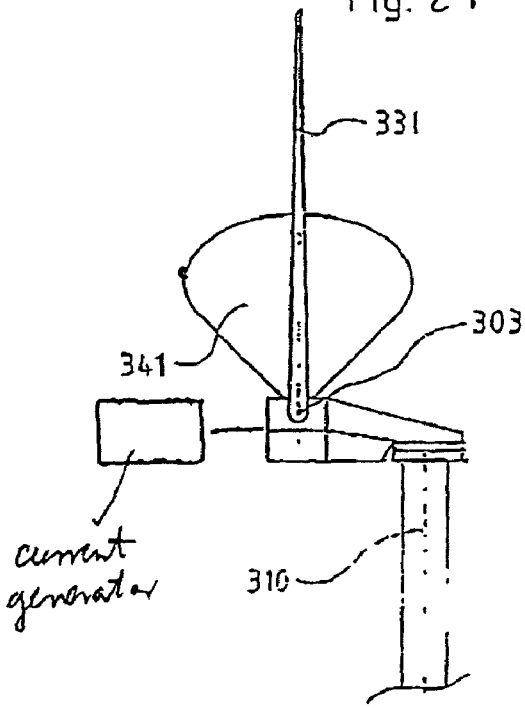
FIG. 21 shows the wind power installation of FIG. 16 including a current generator.
Figure 22:
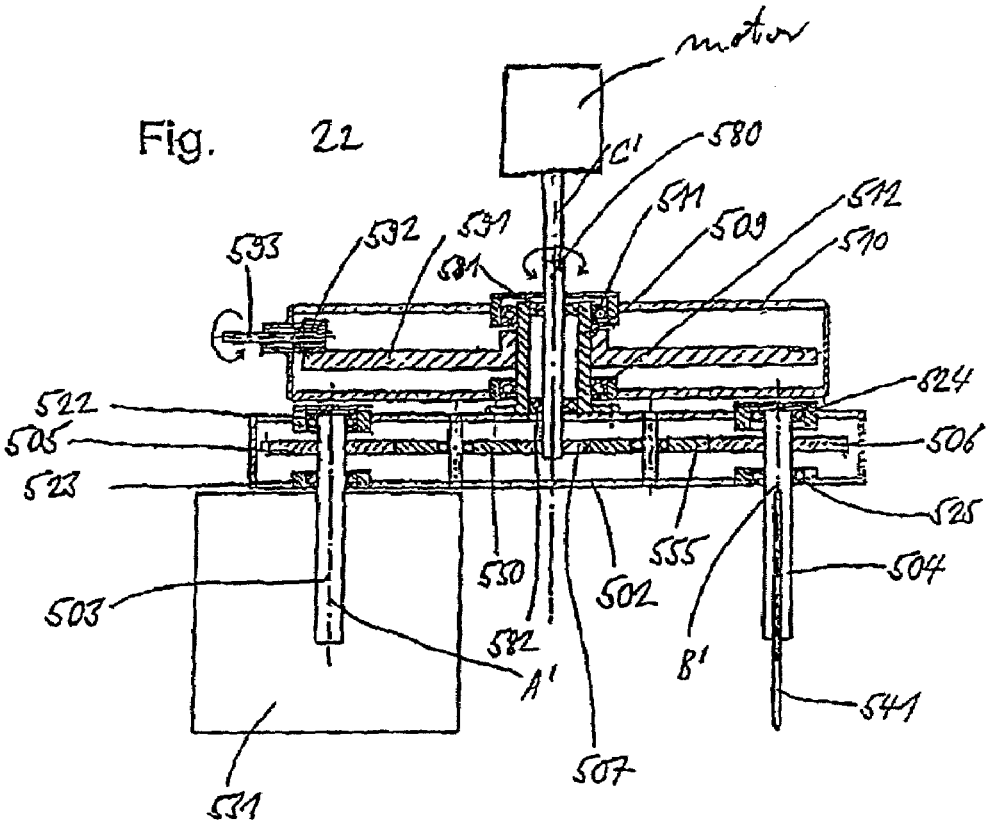
FIG. 22 shows a further partial section view of the fourth exemplary embodiment of the device according to the invention for conversion of movement, with two working levers with self rotation axes which are parallel to each other and a motor.

The fifth exemplary embodiment, shown in FIG. 20, of the device for conversion of movement according to the invention largely corresponds to the fourth exemplary embodiment, shown in FIG. 19. The prime difference consists in the fact that the working levers 603, 604, instead of being parallel, are arranged obliquely and not crossed. Correspondingly the paddles 631, 641, the lever bearing element 602, the planetary wheels 605, 606, the transmission wheels 650, 655, the drive shaft 609, the fixed part 610, the adjustment shaft 680, the toothed rim 691 and the shaft 693 with the driving pinion 692 are designed in a geometrically adapted way, without changing their respective function. Therefore, what was said for the fourth exemplary embodiment largely applies, except that the working levers 603, 604, when the drive shaft 609 rotates, each perform a movement defining a truncated cone, and not a movement defining a cylinder.

Since the two working levers 603, 604 are obliquely arranged, the device can be built more compactly in regards to width than with the fourth exemplary embodiment. In exchange it is a bit higher, however still clearly lower than with the exemplary embodiments with crossed working levers.

The device for conversion of movement according to the invention is a base element, which can be used in the most varied ways through corresponding mounting of suitable elements and potentially combination with further base elements.

As well as the above-described uses, utilisation in, for example, ventilation technology for production of a directed conveying current, which remains stable over long stretches, is also conceivable. In tunnels a few ventilators with high flow rate and reversible direction of conveyance can increase safety. The drive motors lie advantageously above the tunnel ceiling.

The device for the conversion of movement according to the invention can also be used like a cable ferry in flowing bodies of water as a floating river power station, wherein for this purpose it is provided with floating bodies. The river current pushes the engaging vanes into rotation, which activates the mounted current generator. No constructional measures are necessary on the river bed, such that the power station is immediately ready for use. The level of water is not important due to the floating bodies.

Specific embodiments of a device for conversion of movement according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A device for conversion of either a rotational movement into a movement of a working lever defining a truncated cone and a self-rotating movement of the working lever, or the other way around, a movement of a working lever defining a truncated cone and a self-rotating movement of the working lever into a rotational movement, with a lever bearing element rotatable around a rotation axis and in which the working lever is self-rotatably positioned around a self-rotation axis, wherein around the rotation axis a sun wheel is arranged which is able to be blocked from turning, with which a planetary wheel, arranged in a non-rotatable manner on the working lever, is coupled via a transmission means, such that with a rotation of the lever bearing element around the rotation axis due to the positioning in the lever bearing element, the working lever carries out a rotation in the same direction of rotation and due to the planetary wheel which is coupled to the sun wheel via the transmission means, the working lever carries out a self-rotation around the self-rotation axis in the opposite direction of rotation, wherein the device for conversion of rotational movement has at least a further working lever, which is self-rotatably positioned in the lever bearing element around a self-rotation axis and on which a planetary wheel of the further working lever is arranged in a non-rotatable manner, the planetary wheel being coupled via a transmission means with the sun wheel or with a further sun wheel arranged around the rotation axis, such that with a rotation of the lever bearing element around the rotation axis due to the positioning in the lever bearing element, the further working lever carries out a rotation in the same direction of rotation and, due to the planetary wheel, of the further working lever, coupled to the sun wheel via the transmission means, the further working lever carries out a self-rotation around the self-rotation axis in the opposite direction of the rotation of the lever bearing element, wherein the at least two working levers are arranged obliquely and at a distance to the rotation axis and cross each other.

2. The device according to claim 1, wherein the planetary wheel, the transmission means and the sun wheel are toothed wheels.

3. The device according to claim 1, wherein the planetary wheel and the sun wheel are chain wheels and the transmission means is a roller chain connecting the chain wheels.

4. The device according to claim 1, wherein the transmission means is a belt or a toothless wheel.

5. The device according to claim 1, wherein the planetary wheels of the at least two working levers are coupled with the same sun wheel.

6. The device according to claim 1, wherein the planetary wheels of the at least two working levers are coupled with separate sun wheels.

7. The device according to claim 1, wherein the lever bearing element is pivotably arranged in a casing and is connected with a shaft which is arranged on the rotation axis and which projects out of the casing.

8. The device according to claim 1, wherein the lever bearing element is connected with a motor for production of the rotational movement, and an operating tool, in the form of a paddle, a vane, or a wing blade, is arranged on each of the working levers.

9. Use of at least one device according to claim 1 as driving apparatus of a locomotion means in water or in air, for production of a water or gas current or for mixing of flowable materials including the step of mounting the device on a locomotion means and placing the locomotion means in air, water or other flowable means.

10. Use of at least one device according to claim 1 as steering of a locomotion means in water or in air, for production of a water or gas current or for mixing of flowable materials including the step of mounting the device on a locomotion means and placing the locomotion means in air, water or other flowable means.

11. The device according to claim 1, wherein a rotation-transmission ratio exists between the planetary wheel and the sun wheel, such that with a rotation of the lever bearing element around 360 degree, the accompanying working lever self-rotates around less than 360 degree.

12. The device according to claim 11, wherein the rotation-transmission ratio is about 2:1.

13. The device according to claim 1 including means with which the sun wheel is rotationally adjustable and which, except when rotationally adjusting, block the sun wheel from turning.

14. The device according to claim 13, wherein said means comprise a chain wheel connected with the sun wheel, a further, rotationally adjustable chain wheel and a chain connecting the two chain wheels.

15. The device according to claim 1, wherein a torque consumer is connected with the lever bearing element, in particular a current generator.

16. Use of a device according to claim 15 for current production through conversion of a movement produced through flowing water or wind of each of two working levers defining a truncated cone, and conversion of a self-rotating movement produced through flowing water or wind of each of the two working levers, into a rotational movement, with which a current generator is operated, each working lever having an operating tool including the step of placing the device into flowing water or wind.

* * * * *